US005091227A

United States Patent [19]

Wright et al.

[11] Patent Number: 5,091,227

[45] Date of Patent: Feb. 25, 1992

[54] DECORATIVE TREE STRUCTURE

[76] Inventors: Jeffery L. Wright; Lisa K. Wright, both of 3171 Sturbridge Ct., Riverside, Calif. 92503

[21] Appl. No.: 679,237

[22] Filed: Apr. 2, 1991

[51] Int. Cl.[5] ..... A41G 1/00

[52] U.S. Cl. ..... 428/18; 156/61

[58] Field of Search ..... 428/18, 19, 20; 362/123; 156/61

[56] References Cited

U.S. PATENT DOCUMENTS 2,070,825 2/1937 Buhrow ..... 428/18 X
2,251,705 8/1941 Gonzalez ..... 428/18 X
3,878,503 4/1975 Martin ..... 362/123 X
3,940,877 3/1976 Culkin ..... 428/18 X
4,966,793 10/1990 Covell ..... 428/128 X

FOREIGN PATENT DOCUMENTS 2944931 6/1981 Fed. Rep. of Germany ..... 428/20

*Primary Examiner*—Henry F. Epstein
*Attorney, Agent, or Firm*—Hawes & Fischer

[57] ABSTRACT

This invention relates to a decorative tree structure with a cluster of leaves, which is easily removed when pulled straight up and is difficult to remove when pulled from the side. The resulting tree structure is safe, durable, easily assembled and disassembled, and particularly adapted to blend in with the furniture of the room in which it is placed.

6 Claims, 2 Drawing Sheets

DECORATIVE TREE STRUCTURE

INTRODUCTION

This invention relates to a decorative tree structure with a cluster of leaves, which are easily removed when pulled straight up and are difficult to remove when pulled from the side, making the tree structure safe, durable, easily assembled and disassembled, and particularly adapted to blend in with the furniture of the room in which it is placed.

Decorative tree structures are in common use today to match bed quilting, couches, office furniture, carpet, wall paper, baby's bedding, etc. to uniquely compliment and complete the decoration of a room. To this end, the decorative tree structures are constructed in various colors with leaves in the same or different colors. The leaves themselves may all be of one color or each in different colors. Additionally, decorative fruits of various sizes and types may be hung on or from the decorative tree structure. Most commonly, the decorative tree structure is placed in a child's room so child safety is the most important consideration.

One object of the present invention is to provide a decorative tree structure that is simple in design and economical to construct, yet which effectively prevents a child from being injured. Another object of the invention is to provide an easy way for an individual to store the decorative tree structure. A further object is to provide a decorative tree structure that is easily used and cleaned. These and further objects of the invention will be apparent from the following description of a preferred embodiment thereof.

BRIEF SUMMARY OF THE INVENTION

The decorative tree structure includes a base to support the decorative tree structure, a tree trunk whose lower end is inserted into a cap molded into the base, a cluster of leaves, which is formed by a collar gathering a plurality of leaves together, inserted into the upper end of the tree trunk. The base and trunk are covered with fabric. The leaves are made of fabric stuffed with batting and contain a wire acting as the leaf stem. Decorative fruit of various types may be included with the cluster of leaves.

BRIEF DESCRIPTION OF THE DRAWING

The invention is shown in connection with the accompanying drawings, in which.

DETAILED DESCRIPTION

The style of the decorative tree structures in use today includes a trunk held by a base. Leaves with wires are stuck into the top of the trunk. These trees are constructed and arranged to make it easy to remove individual leaves.

Figure 1:
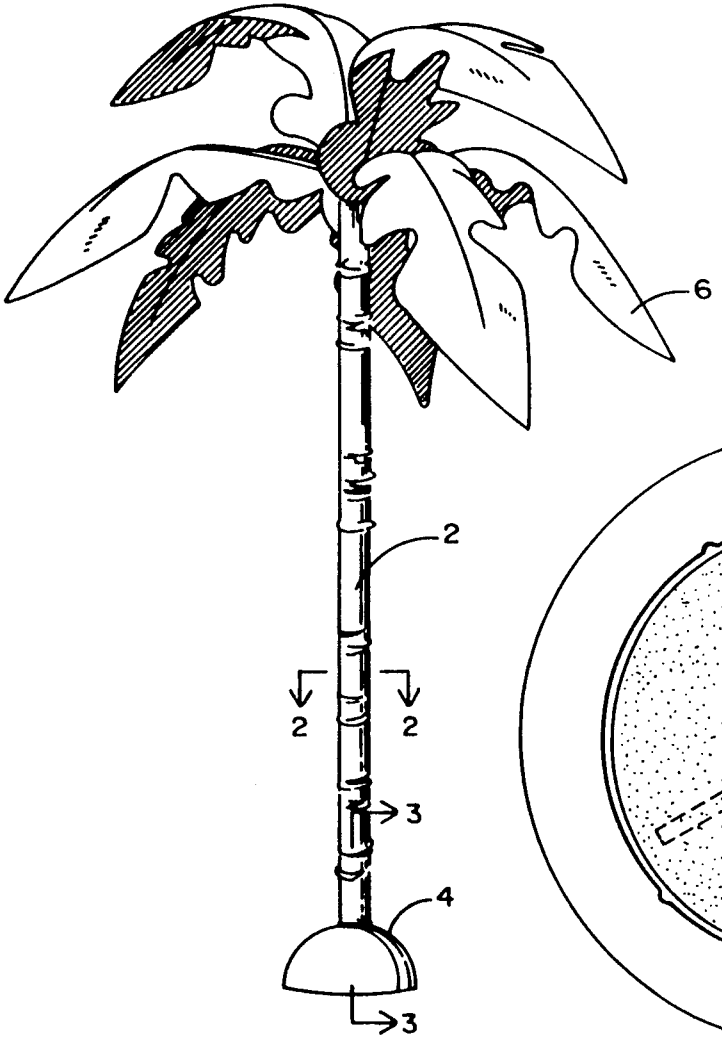
FIG. 1 is a perspective view of a decorative palm tree structure constructed in accordance with the teachings of the present invention.

A decorative palm tree structure of this general type, but which incorporates a preferred embodiment of the present invention, is shown in FIG. 1. It includes a trunk 2, a base 4, and a cluster of leaves 6. The cluster of leaves fits into the top of the tree trunk whose lower end fits into a cap molded into the top of the tree's base.

Figure 2:
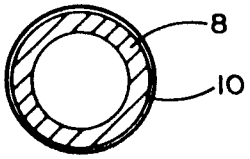
FIG. 2 is a cross-sectional view of the trunk of the decorative palm tree structure taken along lines 2—2 of FIG. 1.

The preferred trunk structure 2, shown in cross-section in FIG. 2, consists of a length of polyvinyl chloride pipe 8 covered with a piece of fabric 10.

Figure 3:
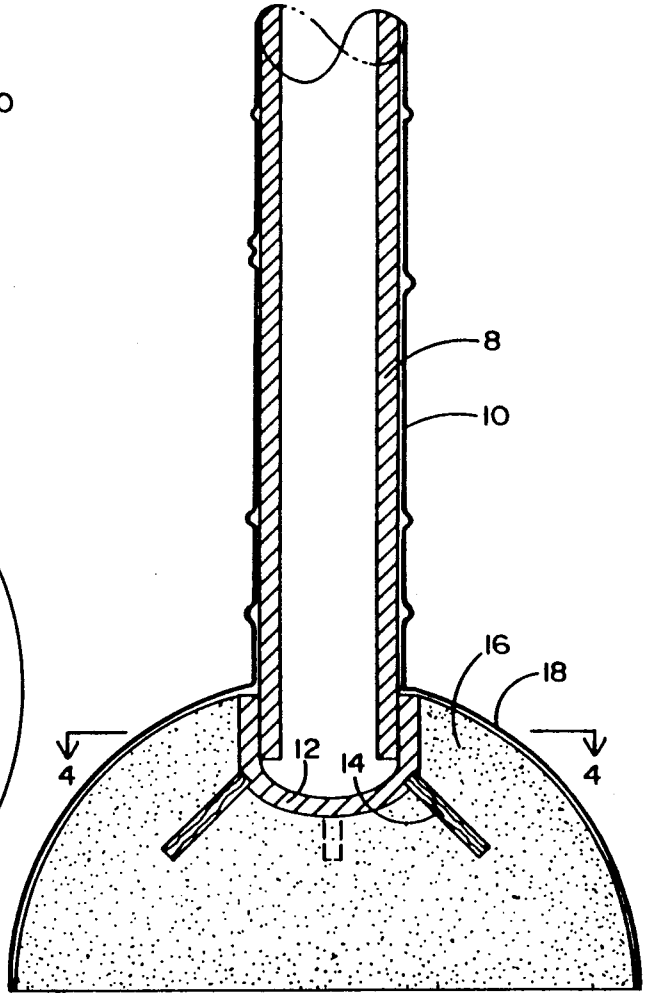
FIG. 3 is a cross-sectional view of the base and trunk of the decorative palm tree structure taken along long lines 3—3 of FIG. 1.
Figure 4:
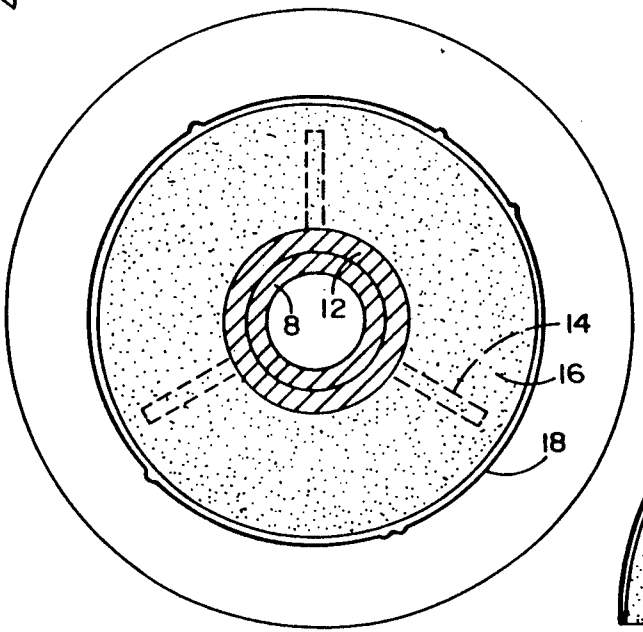
FIG. 4 is a cross-sectional view of the top of the base of the decorative palm tree structure shown in FIG. 3 taken along lines 4—4.

The trunk structure 2 is supported by a base 4. In FIG. 3 a cross-sectional view of this base shows the polyvinyl chloride pipe 8 surrounded with a covering 10 formed in loosely fitted folds inserted into polyvinyl cap 12 for this size pipe having nails or spikes 14 inserted through it and protruding outwardly. This polyvinyl chloride cap and spikes are received in a mass of plaster of Paris 16 covered with fabric 18. The circular shape of the base can be seen in FIG. 4.

Figures 5, 6, 7, 8:
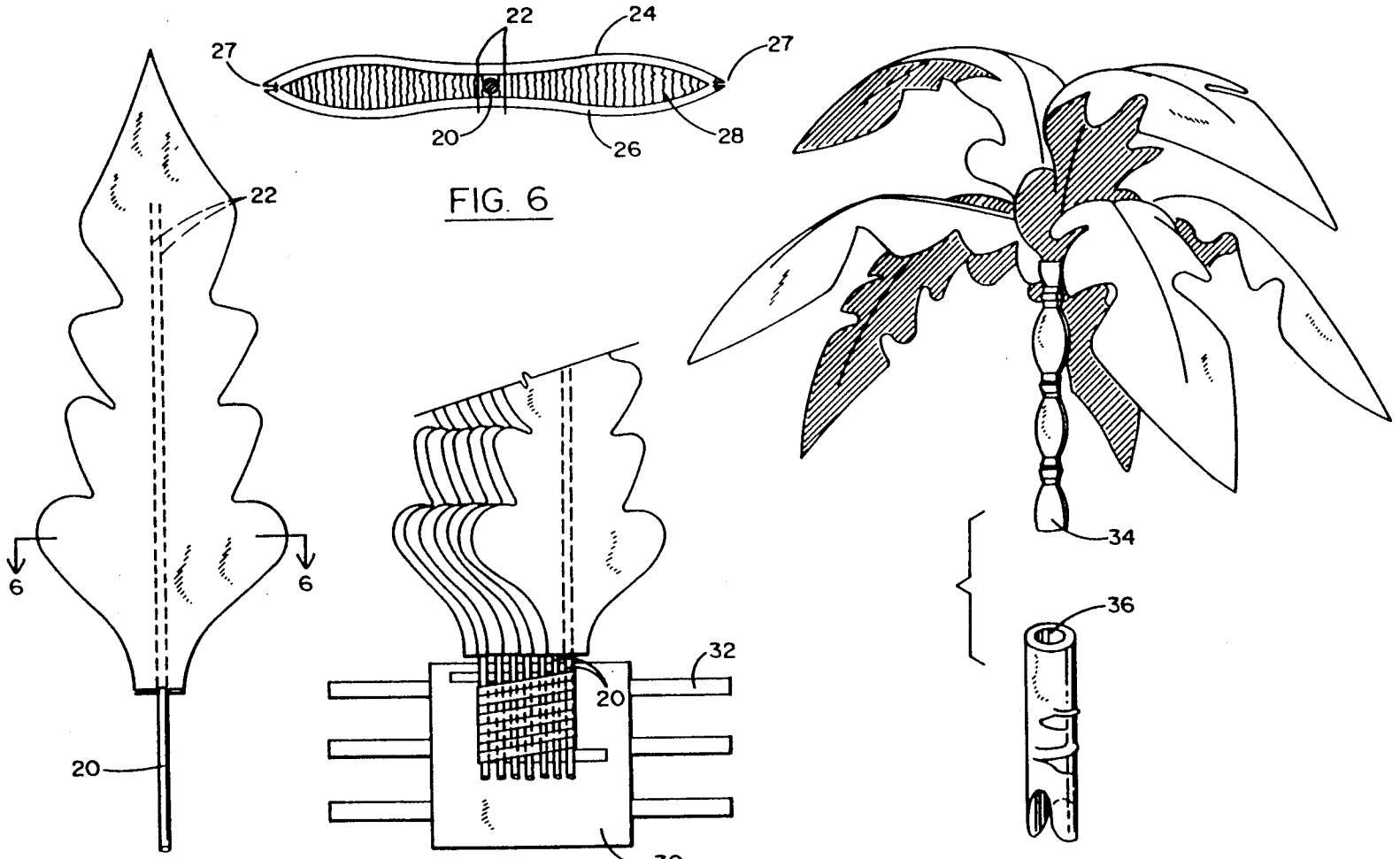
FIG. 5 is a top view of a leaf of the decorative palm tree structure shown in FIG. 1.
FIG. 6 is a cross-sectional view of the leaf of the decorative palm tree structure taken along lines 6—6 of FIG. 5.
FIG. 7 is a plan view of the cluster of leaves of the decorative palm tree structure with their foam collar open and tape unbound.
FIG. 8 is an elevation view of the cluster of leaves of the decorative palm tree structure separated from the top of the decorative tree trunk.

The preferred construction of an individual leaf of the decorative palm tree structure is shown in FIG. 5. This top view of a leaf shows the central wire 20, which acts as the leaf stem, fitting between two rows of stitches 22. This central wire extends about two thirds of the entire longitudinal distance of the fabric envelope for the leaf. This gives support for the leaf and allows the main portion to be bent while not exposing the end of the wire at the top of the leaf.

A cross-sectional view of an individual leaf in FIG. 6 shows the central wire stem 20 between the two rows of stitches 22. The top of the leaf 24 is attached to the bottom of the leaf 26 by the two collections of stitches 27. The entire leaf is filled with cotton or synthetic batting 28. The stitches 27 are completed before the batting 28 is inserted. Stitches 22 are completed after the batting has been sandwiched between the top of the leaf 24 and the bottom of the leaf 26. Wire stem 20 is inserted after the above operations are completed.

To form the cluster of leaves that form the top of the decorative palm tree structure, wire stems from several completed leaves are laid side-by-side as shown in FIG. 7 and wound together with tape. The stems 20 are then placed on a piece of foam rubber 30 which has been placed on top of a plurality of pieces of tape 32. The foam rubber is wrapped around the stems 20 to form a collar so that no wire is exposed and so that the ends of the wire stems are covered by the foam rubber. The tape strips 32 are then tightly secured around the foam rubber to close the collar.

In FIG. 8, the resulting protected cluster of wire leaf stems within their collar 34 will snugly fit into the top of the tree trunk 36. Should anyone pull upward on the leaves, the entire cluster will detach from the trunk. The dangerous wire stems will still be contained within the collar, that is, covered by foam rubber securely wrapped with adhesive tape. Should anyone pull on the leaves from the side, the cluster will not easily detach from the trunk.

The preferred embodiment described prevents a child from pulling individual leaves with their wire stems from the decorative tree structure. The heavy base makes it difficult to topple the tree. The assembling and disassembling of the decorative tree structure from a cluster of leaves, a trunk, and a base is easy so that portability of the tree structure is enhanced. The choice of materials and the fitting together of the various elements of the tree structure enhances its durability.

While preferred embodiments of the invention have been shown and described, it will be apparent to those skilled in this art that various modifications may be made in these embodiments without departing from the spirit of the present invention. For that reason, the scope of the invention is set forth in the following claims.

We claim:

1. A decorative tree structure comprising:

a base to support the tree structure;

a tree trunk having an upper end and lower end, said lower end received into said base;

a fabric covering surrounding said trunk;

a cluster of leaves containing a plurality of leaves; and means, attached to said leaves, for connecting said cluster of leaves to the upper end of said tree trunk.

2. A decorative tree structure as set forth in claim 1 wherein each of said leaves has a stem and in which said means for connecting said cluster of leaves to the upper end of said tree trunk further comprises:

a length of tape surrounding said stems of said leaves;

a piece of foam rubber surrounding said length of tape and said stems; and a plurality of lengths of tape surrounding said piece of foam rubber, the combination of said length of tape, said piece of foam rubber and said plurality of lengths of tape forming a collar.

3. A decorative tree structure as set forth in claim 2 in which said collar covers said stems of the cluster of leaves.

4. A decorative tree structure as set forth in claim 3 in which said base includes an inverted cap for receiving said tree trunk.

5. A decorative tree structure as set forth in claim 4 in which said base consists of a polyvinyl cap, spikes inserted into the cap, a hemispherical mass of molded material surrounding said spikes and said cap, and a fabric covering surrounding said hemispherical mass.

6. A decorative tree structure as set forth in claim 1 in which said tree trunk has the same diameter throughout its length.

* * * * *